US007052813B2

(12) United States Patent
Tong et al.

(10) Patent No.: US 7,052,813 B2
(45) **Date of Patent: *May 30, 2006**

(54) IMAGING MEMBER

(75) Inventors: Yuhua Tong, Webster, NY (US); Timothy J. Fuller, Pittsford, NY (US); Colleen A. Helbig, Penfield, NY (US); Kent J. Evans, Lima, NY (US); John F. Yanus, Webster, NY (US); Karen S. Garland, Clyde, NY (US); Paul J. DeFeo, Sodus Point, NY (US); Anita P. Lynch, Webster, NY (US); Kathleen M. Carmichael, Williamson, NY (US); Damodar M. Pai, Fairport, NY (US); Dale S. Renfer, Webster, NY (US); Markus R. Silvestri, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/197,015

(22) Filed: Aug. 4, 2005

(65) Prior Publication Data

US 2005/0271958 A1 Dec. 8, 2005

Related U.S. Application Data

(62) Division of application No. 10/320,811, filed on Dec. 16, 2002.

(51) Int. Cl.
*G03G 5/047* (2006.01)

(52) U.S. Cl. ..... 430/58.8; 430/59.6; 430/59.4; 430/64; 430/65; 430/970; 430/134; 399/159

(58) Field of Classification Search ..... 430/59.6, 430/58.8, 59.4, 64, 65, 970; 399/159
See application file for complete search history.

(56) References Cited

U.S. PATENT DOCUMENTS

| | | | |
|---|---|---|---|
| 4,233,384 | A | 11/1980 | Turner et al. |
| 4,265,990 | A | 5/1981 | Stolka et al. |
| 4,286,033 | A | 8/1981 | Neyhart et al. |
| 4,291,110 | A | 9/1981 | Lee |
| 4,299,897 | A | 11/1981 | Stolka et al. |
| 4,306,008 | A | 12/1981 | Pai et al. |
| 4,338,387 | A | 7/1982 | Hewitt |
| 4,346,158 | A | 8/1982 | Pai et al. |
| 4,439,507 | A | 3/1984 | Pan et al. |
| 4,654,284 | A | 3/1987 | Yu et al. |
| 4,988,597 | A | 1/1991 | Spiewak et al. |
| 5,244,762 | A | 9/1993 | Spiewak et al. |
| 5,334,478 | A | 8/1994 | Desilets et al. |
| 5,407,766 | A | 4/1995 | Mayo et al. |
| 5,613,173 | A | 3/1997 | Kunzmann et al. |
| 6,261,729 | B1 | 7/2001 | Yuh et al. |
| 2002/0076631 | A1 | 6/2002 | Itami et al. |

*Primary Examiner*—Christopher RoDee
(74) *Attorney, Agent, or Firm*—Eugene O. Palazzo; Fay, Sharpe, Fagan, Minnich & McKee, LLP

(57) ABSTRACT

A charge transport layer for an imaging member comprising a first and second charge transport layer wherein the second charge transport layer comprises a charge transport component, a hindered phenol covalently bonded to a polymer, and an additional polymer binder other than the polymer containing the hindered phenol. The charge transport layer exhibits excellent wear resistance, excellent electrical performance, and excellent print quality.

22 Claims, No Drawings

IMAGING MEMBER

The present application is a division of and claims priority under 35 U.S.C. § 121 to U.S. application Ser. No. 10/320,811, filed Dec. 16, 2002.

BACKGROUND

This invention relates in general to an electrostatographic imaging member, and more specifically, to single and multilayered photoconductive imaging members comprising charge transporting components wherein a hindered phenol is attached to, for example, polymer binders to achieve excellent hole transporting performance, superior cycling stability and minimal migration of the charge image pattern.

REFERENCES

In the art of electrophotography, an electrophotographic member comprising a photoconductive insulating layer on a conductive layer is imaged by first uniformly electrostatically charging the surface of the photoconductive insulating layer. The member is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example, from a developer composition, on the surface of the photoconductive insulating layer. The resulting visible toner image can be transferred to a suitable receiving member, such as paper.

Electrophotographic imaging members are usually multilayered photoreceptors that comprise a substrate support, an electrically conductive layer, an optional charge blocking layer, an optional adhesive layer, a charge generating layer, a charge transport layer, and an optional protective or overcoating layer(s). The imaging members can take several forms, including flexible belts, rigid drums, plates, etc. For many multilayered flexible photoreceptor belts, an anticurl layer is usually employed on the backside of the substrate support, opposite to the side carrying the electrically active layers, to achieve the desired photoreceptor flatness.

Various combinations of materials for charge generating layers and charge transport layers have been disclosed. U.S. Pat. No. 4,265,990 discloses a layered photoreceptor having a separate charge generating (photogenerating) layer and charge transport layer. The charge generating layer is capable of photogenerating holes and injecting the photogenerated holes into the charge transport layer. The photogenerating layer utilized in multilayered photoreceptors include, for example, inorganic photoconductive particles, or organic photoconductive particles, dispersed in a film forming polymeric binder. Inorganic or organic photoconductive materials may be formed as a continuous, homogeneous photogenerating layer. The disclosure of this patent is incorporated herein by reference in its entirety.

Examples of electrophotographic members having at least two electrically operative layers including a charge generating layer and diamine containing transport layer are disclosed in U.S. Pat. Nos. 4,265,990, 4,233,384, 4,306,008, 4,299,897 and 4,439,507. The disclosures of these patents are incorporated herein by reference in their entirety.

In multilayer photoreceptor devices, one property of value, for example, is the charge carrier mobility in the transport layer. Charge carrier mobility determines the velocities at which the photo-injected carriers transit the transport layer. For greater charge carrier mobility capabilities, for example, it may be necessary to increase the concentration of the active component transport compounds dissolved or molecularly dispersed in the charge transport binder. Phase separation or crystallization can determine an upper limit to the concentration of the transport components that can be dispersed in a binder. What is still desired is an improved material for a charge transport layer of an imaging member that exhibits excellent electrical performance properties, for example, anti-oxidization, anti-cracking, and cycling stability and minimizes lateral conductivity migration of the charge image pattern. This is achieved in embodiments of the present invention with a polymer binder containing a hindered phenol and wherein the hindered phenol is present in an amount of from, for example, about 1 weight percent to about 30 weight percent based on the weight of the total solids present in the charge transport layer and wherein the polymer and hole transport component combination are substantially soluble in organic solvents, such as, for example, methylene chloride, toluene and tetrahydrofuran.

SUMMARY

Disclosed herein is an electrophotographic imaging member comprising, a supporting substrate,
a charge blocking layer,
an optional adhesive layer,
a charge-generating layer,
a charge transporting layer comprised of a hole transport component and a hindered phenol covalently bonded to or attached to a polymer, and
a binder;

a charge transporting compound for use in a charge transport layer of an imaging member, that minimizes lateral conductivity migration of the charge image pattern;

a charge transport material containing a hindered phenol attached to the charge transport layer polymer binder wherein the polymer is selected, for example, from the group consisting of polyesters, polyvinyl butyrals, polycarbonates, polystyrene-b-polyvinyl pyridine, poly(vinyl butyral), poly(vinyl carbazole), poly(vinyl chloride), polyacrylates, polymethacrylates, copolymers of vinyl chloride and vinyl acetate, phenoxy resins, polyurethanes, poly(vinyl alcohol), polyacrylonitrile, polysiloxanes and polystyrene. With the disclosed hindered phenol attached to a polymer there is achieved an imaging member with excellent charge transporting performance, minimized migration of the image charge on the photoconductor surface with excellent cycling stability, and which charge transport layer may be coated onto the imaging member structure using known conventional methods.

Aspects illustrated herein relate to an imaging member comprising, for example, a supporting substrate, a charge blocking layer,
an optional adhesive layer,
a charge-generating layer,
a charge transporting layer coated in two passes and wherein the second coating comprises a hole transport component and a hindered phenol attached to a polymer, an optional anticurl layer, and
a binder.

The charge transport layer is in embodiments capable of supporting the injection of photo-generated holes and electrons from a charge generating layer and allowing the transport of these holes or electrons through the transport layer to selectively discharge the surface charge. When some of the charges are trapped inside the transport layer, the surface charges will not completely discharge and the toner image will not be fully developed on the surface of the photoreceptor.

The charge transport layer thus includes at least one charge transport material. For example, in embodiments, the charge transport layer is formed in two coating passes and wherein for the second pass there is selected a hole transport component and hindered phenol attached to a polymer. In specific embodiments, the hindered phenol comprises, for example, butylated hydroxytoluene (BHT) and octadecyl-3, 5-di-tert-butyl-4-hydroxyhydro-cinnamate (IRGANOX-1010®), available from Ciba Specialty Chemicals. In another embodiment, the charge transport layer is formed in one or two coating passes and comprises a hole transport component and a hindered phenol covalently bonded to a polysilsequioxane.

In embodiments, the charge transport layer comprises from about 20 to about 80 percent by weight of at least one charge transport material, and about 80 to about 20 percent by weight of a polymer binder. In a specific embodiment, the charge transport layer comprises from about 20 to about 40 percent by weight of at least one charge transport material, and from about 60 to about 80 percent by weight of a polymer binder.

The solvent can be included in the charge transport layer for the preparation thereof. With the present invention embodiments, the charge transport layer is less expensive than a charge transport layer formed with some conventional polycarbonate binder resins, and the solvent can comprise acetone, xylene, tetrahydrofuran, toluene, and the like.

The total of coating material solids to total solvents may for example, be about 5:95 weight percent to about 35:65 weight percent, and in embodiments, from about 15:85 weight percent to about 25:75 weight percent.

The charge transport layer solution is applied in two passes. More specifically, the charge transport layer is formed upon a previously formed charge generating layer of the photoreceptor. In embodiments, the charge transport layer may contain any suitable arylamine hole transporting components, such as those represented by:

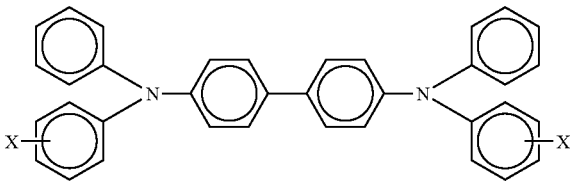

wherein X is selected from the group consisting of alkyl and halogen. Typically, the halogen is a chloride. Alkyl typically contains, for example, from about 1 to about 10 carbon atoms, and in embodiments, from about 1 to about 5 carbon atoms. Examples of aryl amines include, for example, N,N'-diphenyl-N,N'-bis(alkylphenyl)-1, 1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other specific examples of aryl amines include tri(p-methylphenyl)amine, N,N'-bis(3,4 dimethylphenyl)-N"(1-biphenyl) amine, 2-bis((4'-methylphenyl) amino-p-phenyl) 1,1-diphenyl ethylene, 1-bisphenyl-diphenylamino-1-propene, and the like.

In one embodiment, the charge transport layer is formed upon a charge generating layer wherein N,N'-diphenyl-N, N'-bis(3-methylphenyl)-[1, 1'-biphenyl]-4, 4'-diamine and a polymer binder, for example, MAKROLON®, are applied during the first pass. During the second pass, N,N'-diphenyl-N, N'-bis (3-methylphenyl)-[1,1'-biphenyl]4,4'diamine and a polystyrene comprising a hindered phenol, and a polymer binder dissolved in a solvent other than methylene chloride are deposited to complete the charge transport layer. In another embodiment, the charge transport layer is formed wherein N,N'-diphenyl-N, N'-bis(3-methylphenyl)-[1,1'-biphenyl]-4,4'diamine and, for example, MAKROLON® are applied during the first pass. During the second pass, N,N'-diphenyl-N,N'-bis(3-methylphenyl)-[1,1'-biphenyl]-4,4'diamine and a polysilsequioxane comprising a hindered phenol, and a polymer binder dissolved in tetrahydrofuran are applied to the first charge transport layer. In yet another embodiment, the charge transport layer is formed wherein N,N'-diphenyl-N, N'-bis(3-methylphenyl)-[1,1'-biphenyl]-4, 4'diamine and, for example, MAKROLON® are applied during the first pass. During the second pass, N,N'-diphenyl-N,N'-bis(3-methylphenyl)-[1,1'-biphenyl]-4,4'diamine and a fluoro-polymer with ioscyanate groups (Ausimont, Fluorobase Z 300) comprising a hindered phenol dissolved in toluene are coated on top of the first charge transport layer. In a further embodiment, the charge transport layer is formed wherein N,N'-diphenyl-N,N'-bis(3-methylphenyl)-[1,1'-biphenyl]-4, 4'diamine and, for example, MAKROLON® are applied during the first pass. During the second pass, N,N'-diphenyl-N,N'-bis(3-methylphenyl)-[1,1'-biphenyl]-4,4'diamine and a aminopropyl group functionalized polysilsesquioxane, available from Gelest, Inc., comprising a hindered phenol dissolved in xylene formed the second pass. Any suitable and conventional techniques may be utilized to apply the charge transport layer coating solution to the photoreceptor structure. Typical application techniques include, for example, spraying, dip coating, extrusion coating, roll coating, wire wound rod coating, draw bar coating, and the like.

The dried, two pass charge transport layer has in embodiments a thickness of from about 5 to about 500 micrometers and more specifically has a thickness of, for example, from about 10 micrometers to about 50 micrometers. In general, the ratio of the thickness of the charge transport layer to the charge generating layer is in embodiments maintained from about 2:1 to about 200:1, and in some instances about 400:1 and which charge transport layer possesses excellent wear resistance.

The charge generating layer, charge transport layer, and other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. In embodiments, however, the charge transport layer is deposited upon a charge generating layer in two passes, and the charge transport layer may optionally be overcoated with an overcoat and/or protective layer.

The photoreceptor substrate may be opaque or substantially transparent, and may comprise any suitable organic or inorganic material having the requisite mechanical properties. The substrate can be formulated entirely of an electrically conductive material, or it can be an insulating material including inorganic or organic polymeric materials, such as MYLAR®, a commercially available polyester polymer, MYLAR® coated titanium, a layer of an organic or inorganic material having a semiconductive surface layer, such as, indium tin oxide, aluminum, titanium, and the like, or exclusively be made up of a conductive material such as, aluminum, chromium, nickel, brass, and the like. The substrate may be flexible, seamless, or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer having an electrically conductive surface. The thickness of the substrate layer depends on numerous factors, including mechanical performance and economic considerations. The thickness of this layer may range from about 25 micrometers to about 1,000 micrometers, and in embodiments from about 50 micrometers to about 500 micrometers for optimum flexibility and minimum induced surface bending stress when cycled around small diameter rollers, for example, 19 millimeter diameter rollers. The surface of the substrate layer is in embodiments cleaned prior to coating to promote greater adhesion of the deposited coating composition. Cleaning may be effected by, for example, exposing the surface of the substrate layer to plasma discharge, ion bombardment, and the like methods. Similarly, the substrate can be either rigid or flexible. In embodiments, the thickness of this layer is from about 3 millimeters to about 10 millimeters. For flexible belt imaging members, for example, the substrate thickness ranges from about 65 to about 150 micrometers, and in embodiments, from about 75 to about 100 micrometers for optimum flexibility and minimum stretch when cycled around small diameter rollers of, for example, 19 millimeter diameter. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semi-transparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein, or through conditioning in a humid atmosphere to ensure the presence of sufficient water content to render the material conductive, indium, tin, metal oxides, including tin oxide and indium tin oxide, and the like.

The conductive layer of the substrate can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and in embodiments from about 100 to about 200 Angstroms for an optimum combination of electrical conductivity, flexibility, and light transmission. A hole blocking layer may then optionally be applied to the substrate. Generally, electron blocking layers for positively charged photoreceptors allow the photogenerated holes in the charge generating layer at the surface of the photoreceptor to migrate toward the charge (hole) transport layer below and reach the bottom conductive layer during the electrophotographic imaging processes. Thus, an electron blocking layer is normally not expected to block holes in positively charged photoreceptors such as, photoreceptors coated with a charge generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material. The charge blocking layer may include polymers such as, polyvinylbutyral, epoxy resins, polyesters, polysiloxanes, polyamides, polyurethanes, and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]$ $CH_3Si(OCH_3)_2$, (gamma-aminopropyl)-methyl diethoxysilane, as disclosed in U.S. Pat. Nos. 4,338,387, 4,286,033 and 4,291,110. Other suitable charge blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters that modified polymers are then blended with other vinyl hydroxy ester and amide polymers. An example of such a blend is a 30 mole percent benzoate ester of poly(2-hydroxyethyl methacrylate) blended with the parent polymer poly (2-hydroxyethyl methacrylate). Still other suitable charge blocking layer polymer compositions are described in U.S. Pat. No. 4,988,597. An example of such an alkyl acrylamidoglycolate alkyl ether containing polymer is the copolymer poly(methyl acrylamidoglycolate methyl ether-co-2-hydroxyethyl methacrylate). The disclosures of each of the above U.S. Patents are incorporated herein by reference in their entirety.

The blocking layer is continuous and may have a thickness of less than about 10 micrometers. In embodiments, a blocking layer of from about 0.005 micrometers to about 1.5 micrometers facilitates charge neutralization after the exposure step and optimum electrical performance is achieved. The blocking layer may be applied by any suitable conventional technique such as, spraying, dip coating, draw bar coating, gravure coating, silk screening, air knife coating, reverse roll coating, vacuum deposition, chemical treatment, and the like. For convenience in obtaining thin layers, the blocking layer is, in embodiments, applied in the form of a dilute solution, with the solvent being removed after deposition of the coating by conventional techniques such as, by vacuum, heating, and the like. Generally, a weight ratio of blocking layer material and solvent of between about 0.05:100 to about 5:100 is satisfactory for spray coating.

If desired, an optional adhesive layer may be formed on the substrate. Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer is applied directly to the charge blocking layer. Thus, the adhesive layer is in embodiments in direct contiguous contact with both the underlying charge blocking layer and the overlying charge generating layer to enhance adhesion bonding and to effect ground plane hole injection suppression. Drying of the deposited coating may be effected by any suitable conventional process, such as, oven drying, infrared radiation drying, air drying, and the like. More specifically the adhesive layer has a thickness of, for example, from about 0.01 micrometers to about 2 micrometers after drying. In embodiments, the dried thickness is from about 0.03 micrometers to about 1 micrometer.

The components of the photogenerating layer comprise photogenerating particles, for example, of Type V hydroxygallium phthalocyanine, x-polymorph metal free phthalocyanine, or chlorogallium phthalocyanine photogenerating pigments dispersed in a matrix comprising an arylamine hole transport components and certain selected electron transport components. Type V hydroxygallium phthalocyanine is well known and has X-ray powder diffraction (XRPD) peaks at, for example, Bragg angles (2 theta +/−0.2°) of 7.4, 9.8, 12.4, 16.2, 17.6, 18.4, 21.9, 23.9, 25.0, 28.1, with the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The Diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments have an average particle size of less than about 5 micrometers.

The thickness of the photogenerating layer is, for example, from about 0.05 micrometers to about 100 micrometers and, in embodiments, from about 0.05 micrometers to about 40 micrometers. The photogenerating layer containing photoconductive compositions and/or pigments, and the resinous binder material in embodiments, ranges in thickness of from about 0.1 micrometers to about 5 micrometers, and more specifically is of a thickness of from about 0.3 micrometers to about 3 micrometers to permit excellent light absorption and improved dark decay stability and excellent mechanical properties.

When the photogenerating material is present in a binder material, the photogenerating composition or pigment may be present in the film forming polymer binder compositions in any suitable or desired amounts. For example, from about 10 percent by volume to about 60 percent by volume of the photogenerating pigment may be dispersed in from about 40 percent by volume to about 90 percent by volume of the film forming polymer binder composition and, in embodiments, from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight and, in embodiments, from about 25 to about 75 percent by weight, and the binder is present in an amount of from about 20 to about 95 percent by weight and, in embodiments, from about 25 to about 75 percent by weight, although the relative amounts can be outside these ranges. The photogenerating layer containing photoconductive compositions and the resinous binder material generally ranges in thickness from about 0.05 microns to about 100 microns or more and, in embodiments, from about 0.1 microns to about 5 microns, and in more specific embodiments having a thickness of from about 0.3 microns to about 3 microns, although the thickness may be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as, mechanical considerations, the specific photogenerating compound selected, the thicknesses of the other layers, and whether a flexible photoconductive imaging member is desired. The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as, oven drying, infrared radiation drying, air drying, and the like.

Any suitable film forming binder may be utilized in the photoconductive insulating layer or the charge generating layer. Examples of suitable binders for the photoconductive materials and charge generator layer include thermoplastic and thermosetting resins such as polycarbonates.

Specific electrically inactive binders for the charge generator layer include poly (4,4'-isopropylidene diphenyl carbonate), poly(4,4'-diphenyl-1, 1'-cyclohexane carbonate); poly(4,4'-diphenyl-1,1'-cyclohexane carbonate)-500, with a weight average molecular weight of 51,000; or poly(4,4'-diphenyl-1,1'-cyclohexane carbonate)-400, with a weight average molecular weight of 40,000.

The charge transport layer not only serves to transport holes or electrons, but also protects the photoconductive device from abrasion or chemical attack. The charge transport layer is normally transparent in a wavelength region in which the electrophotographic imaging member is to be used when exposure is effected therethrough to ensure that most of the incident radiation is utilized by the underlying charge generating layer. The charge transport layer should exhibit negligible charge generation and discharge, if any, when exposed to a wavelength of light useful in xerography, for example, 4000 to 9000 Angstroms. When used with a transparent substrate, imagewise exposure or erase may be accomplished through the substrate with all light passing through the substrate. In this case, the charge transport material need not transmit light in the wavelength region of use if the charge generating layer is sandwiched between the substrate and the charge transport layer. The charge transport layer in conjunction with the charge generating layer is an insulator to the extent that an electrostatic charge placed on the charge transport layer is not conducted in the absence of illumination. The charge transport layer should trap minimal charges; either holes for a negatively charged system, or electrons for a positively charged system. Charge transport layer materials are well known in the art.

The charge transport layer may, for example, comprise activating compounds or charge transport components dispersed in an electrically inactive film forming polymeric materials for making these materials electrically active. These charge transport components may be added to polymeric materials which are incapable of supporting the injection of photogenerated holes and incapable of allowing the transport of these holes.

Any suitable arylamine hole transporting components may be utilized in the charge transport layer. In embodiments, an arylamine charge hole transporting component may be represented by:

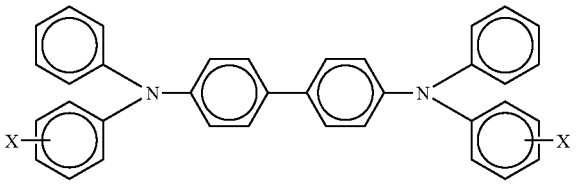

wherein X is selected from the group consisting of alkyl and halogen. Typically, the halogen is a chloride. The alkyl typically contains from 1 to about 10 carbon atoms and, in embodiments, from 1 to about 5 carbon atoms. Typical aryl amines include, for example, N,N'-diphenyl-N,N'-bis(alkyl phenyl)-1, 1-biphenyl-4,4'-diamine wherein alkyl is selected from the group consisting of methyl, ethyl, propyl, butyl, hexyl, and the like; and N,N'-diphenyl-N,N'-bis(halophenyl)-1, 1'-biphenyl-4,4'-diamine wherein the halo substituent is preferably a chloro substituent. Other specific examples of aryl amines include, tritolylamine, N,N'-bis(3,4 dimethylphenyl)-N"(1-biphenyl) amine, 2-bis((4'-methylphenyl) amino-p-phenyl) 1,1-diphenyl ethylene, 1-bisphenyl-diphenylamino-1-propene, and the like.

In embodiments, the charge transport layer is coated in two passes, for example, N,N'-diphenyl-N,N'-bis(3-methylphenyl)-[1,1'-biphenyl]-4, 4'diamine in a binder polymer is deposited in the first pass. In the second pass, N,N'-diphenyl-N,N'-bis(3-methylphenyl)-[1,1'-biphenyl]-4,4'-diamine dispersed in a hindered phenol attached to a binder polymer is then deposited.

In a further specific embodiment, a dispersion of N,N'-diphenyl-N,N'-bis (3-methylphenyl)-[1,1'-biphenyl]-4,4'diamine in a polycarbonate binder is deposited, followed by a coating of N,N'-diphenyl-N,N'-bis(3-methylphenyl)-[1,1'-biphenyl]-4, 4'diamine, and polystyrene, poly(4,4'-diphenyl)-1,1'-cyclohexane carbonate or a polyphthalate carbonate.

In still another embodiment, N,N'-diphenyl-N,N'-bis(3-methylphenyl)-[1, 1'-biphenyl]-4,4'diamine in a mixture of MAKROLON® and polysilsesquioxane attached to octadecyl-3,5-di-tert-butyl-4-hydroxyhydro-cinnamate (IRGANOX®) forms the charge transport layer.

Optionally, an overcoat layer and/or a protective layer can also be utilized to improve resistance of the photoreceptor to abrasion. In some cases, an anticurl back coating may be applied to the surface of the substrate opposite to that bearing the photoconductive layer to provide flatness and/or abrasion resistance where a web configuration photoreceptor is fabricated. These overcoating and anticurl back coating layers are well known in the art, and can comprise thermoplastic organic polymers or inorganic polymers that are electrically insulating or slightly semiconductive. Overcoatings are continuous and typically have a thickness of less than about 10 microns, although the thickness can be outside this range. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat can have a thickness of at most 3 microns for insulating matrices and at most 6 microns for semi-conductive matrices.

The imaging members of the present invention can be utilized in an electrophotographic imaging process by, for example, first uniformly electrostatically charging the photoreceptor, then exposing the charged photoreceptor to a pattern of activating electromagnetic radiation such as light, which selectively dissipates the charge in the illuminated areas of the photoreceptor while leaving behind an electrostatic latent image in the non-illuminated areas. This electrostatic latent image may then be developed at one or more developing stations to form a visible image by depositing finely divided electroscopic toner particles, for example, from a developer composition, on the surface of the photoreceptor. The resulting visible toner image can be transferred to a suitable receiving member, such as paper. The photoreceptor is then typically cleaned at a cleaning station prior to being re-charged for formation of subsequent images.

EXAMPLE I

A polystyrene polymer attached to a hindered phenol was prepared as follows. To a 250-milliliter three-necked flask there was attached a condenser, a Dean-stark trap, an inert gas inlet tube and a magnetic stir bar to which there was added, 4.4 grams of poly(styrene-co-allyl alcohol) having a weight average molecular weight (Mw) of about 2000 and available from Polysciences, Inc. with 5.7 grams of 3-[4-hydroxyl-3, 5-di-tert-butylphenyl]-propionic acid and 70 milliliters of toluene. Upon heating to 100 degrees Celsius, with stirring, the solid disappeared slowly. To the resulting yellowish clear solution, 1 milliliter of concentrated sulfuric acid was added. The solution turned brown immediately. Under argon gas flow, the resulting reaction mixture was then refluxed for 18 hours. Then the cooled brown solution was poured into 100 milliliters of methanol with extensive stirring. The slight-brown precipitate resulting was collected by filtration, and washed in 100 milliliters of deionized water and 3×30 milliliters of methanol continuously. The final product was dried in a vacuum oven at 70 degrees Celsius.

Layered photoreceptor devices were prepared by hand coating charge transport layers on coated charge generation layers of 50 weight percent hydroxy gallium phthalocyanine in poly (4,4'-diphenyl-1,1'-cyclohexane carbonate) (PCZ). A twenty-five micron thick charge transport layer was fabricated by dispersing 50 percent by weight N,N'-diphenyl-N, N'-bis (3-methyl phenyl)-[1,1'-biphenyl]4,4'-diamine (mTBD) in polycarbonate MAKROLON®, using methylene chloride as solvent. The unfinished device was oven dried at 80 degrees Celsius for 30 minutes. Then onto this device, another five micron thick charge transport layer was coated with a solution comprising 50 percent by weight N,N'-diphenyl-N,N'-bis(3-methyl phenyl)-[1, 1'-biphenyl] 4,4'-diamine (mTBD) in the prepared polystyrene polymer above employing tetrahydrofuran as solvent. The completed device was oven dried at 100 degrees Celsius for 30 minutes.

The device was tested for positive charge acceptance to determine the stability when exposed to corona effluents. The center portion of the device is exposed to corona effluents for 10 minutes. After exposure the device is recharged positive and, then, the potential of the exposed center is compared to the potential of the unexposed parts to the left and right of center. A drop in the potential of the center part with respect to the unexposed parts on the left and right is termed a positive charge acceptance loss. A large positive charge acceptance loss is a result of a large number of free positive charge carriers (also referred to as holes) which are found to cause deletion in latent images. Recharging the device and examining the difference of the potentials is also repeated to study the recovery rate from the corona effluent exposure. The device tested here showed very substantial reduction in positive charge acceptance loss and much higher recovery rate with respect to control devices fabricated without the hindered phenol indicating a very significant improvement in resistance to the detrimental effects of corona effluent exposure. Residual potential is defined as the remaining surface potential after full discharge from white light exposures in excess of 200 ergs·cm$^{-2}$ was monitored for 10000 charge-discharge cycles. No significant changes were found indicating very good electric cyclic stability.

EXAMPLE II

A fluoropolymer grafted to a hindered phenol, octadecyl-3, 5-di-tert-butyl-4-hydroxyhydro-cinnamate (IRGANOX-1010) was prepared as follows. To a 250-milliliter three-necked flask cooled by an ice water bath there was attached a condenser, a Dean-stark trap, an inert gas inlet tube and a magnetic stir bar to which there was added 10.0 grams fluoropolyether, soluble in organic solvent, available from Ausimont and prepared by a photo-oxidation polymerization process as FLUOROBASE Z 300®, 13.9 grams of 3-[4-hydroxyl-3,5-di-tert-butylphenyl]propionic acid and 60 milliliters of acetone. After the addition was completed, the ice-water bath was removed, and the reaction mixture was stirred at room temperature, about 22 to about 25 degrees Centigrade for an additional 12 hours. The reaction was monitored by FT-IR until no absorbance peak at 2217 cm$^{-1}$ for-NCO was observed. Then half of the acetone solvent was removed using a rotary evaporator under reduced pressure. The solution that remained was poured into 150 milliliter of methanol with vigorous stirring. The final product, an off-white powder, was collected by filtration and dried in a vacuum oven at 70 degrees Celsius.

The photoreceptor device comprising a hindered phenol attached to the fluoropolymer in the second pass of the charge transport layer was fabricated, and tested in the same method as in Example I. The device showed excellent resistance to corona effluents.

EXAMPLE III

A hindered phenol attached to polysilsesquioxane was prepared as follows. Five grams of an Aminopropyl group functionalized polysilsesquioxane in a water solution available from Gelest, Inc., and 6 grams of IRGANOX-1010®, available from Ciba-Geigy Co., were combined with 120 milliliter of xylenes in a flask. With stirring, the mixture was heated to a refluxing temperature of xylenes (about 140 degrees Celsius) for 15 hours. Dean-Stark trapper was used to collect the water. FT-IR was used to trace the reaction. After the reaction was completed, the absorbent peak at 1718 cm$^{-1}$ (—COO— in IRGANOX-1010®) disappeared in FT-IR spectra, and a new peak at 1663 cm$^{-1}$ (—CONH— in the product) was observed. The solvents were removed under reduced pressure and the remaining paste was washed with water and methanol. The final product collected by filtration was soluble in tetrahydrofuran and methylene chloride.

The route of the synthesis in this example is shown as follows:

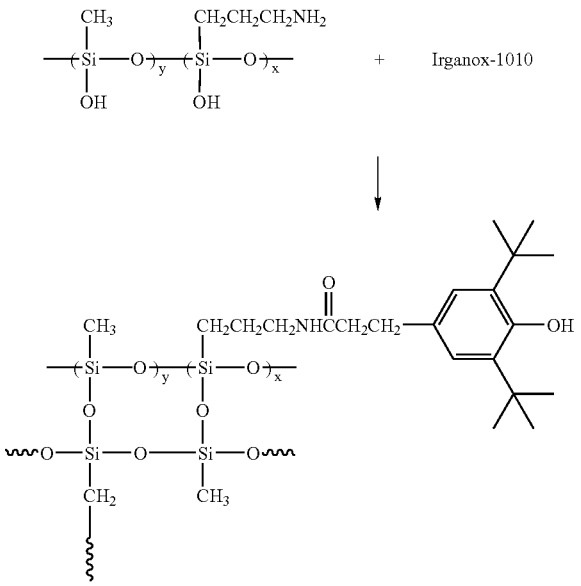

Layered photoreceptor devices were prepared by hand coating a charge transport layer formed by 2 passes on a coated charge generation layers of 50 weight percent hydroxy gallium phthalocyanine in poly(4,4'-diphenyl-1, 1'-cyclohexane carbonate) (PCZ). A 25 micron thick charge transport layer was fabricated by dispersing 50 percent by weight of N, N'-diphenyl-N,N'-bis(3-methyl phenyl)-[1,1'-biphenyl]4,4'-diamine in a polycarbonate binder, MAKROLON®, using methylene chloride as solvent. The unfinished device was oven dried at 80 degrees Celsius for 30 minutes. Onto this device, a five micron thick top charge transport layer was fabricated by dispersing 50 percent by weight of N,N'-diphenyl-N,N'-bis(3-methyl phenyl)-[1,1'-biphenyl]4, 4'-diamine and 5 percent by weight of polysilsesquioxane grafted by hindered phenols in a polycarbonate binder, MAKROLON®, using methylene chloride as solvent. The completed device was oven dried at 100 degrees Celsius for 30 minutes.

Using the same method as in Example I, the electrical test showed excellent stability of this device. Mobility of the positive charge carriers (also referred to as holes) measured by the time of flight technique yielded values ranging from a few $10^6$ $cm^2V^{-1}s^{-1}$ to a few $10^5$ $cm^2V^{-1}s^{-1}$ for typical fields encountered under normal operation in organic photoconductors (typically larger than $10^4$ $Vcm^{-1}$). With respect to control devices fabricated without the hindered phenol attached to the polysilsesquioxane no significant raise in residual potential is observed. This demonstrates that the photoreceptor, containing surfactant polysilsesquioxanes with hindered phenols possesses unchanged electrical properties with superior corona resistance.

The photoreceptor of the present invention may be charged using any conventional charging apparatus, which may include, for example, an AC bias charging roll (BCR), see, for example, U.S. Pat. No. 5,613,173, incorporated herein by reference in its entirety. Charging may also be effected by other known methods, for example, utilizing a corotron, dicorotron, scorotron, pin charging device, and the like.

Although the invention has been described with reference to specific embodiments, it is not intended to be limited thereto. Rather, those having ordinary skill in the art will recognize that variations and modifications, including equivalents, substantial equivalents, similar equivalents, and the like may be made therein which are within the spirit of the invention and within the scope of the claims.

What is claimed is:

1. An imaging member comprising:

a substrate, an optional charge blocking layer, a charge generating layer, a first and a second charge transport layer wherein the first charge transport layer comprises a charge transport component and a polycarbonate polymer binder, and wherein the second charge transport layer comprises a charge transport component, a hindered phenol covalently bonded to a polymer, and an additional polymer binder other than the polymer containing a hindered phenol.

2. An imaging member according to claim 1, wherein the charge transport component comprises an arylamine represented by:

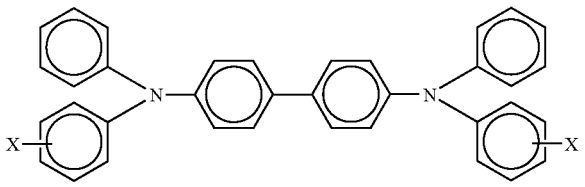

wherein X is selected from the group consisting of alkyl and halogen.

3. An imaging member according to claim 1, wherein said charge transport component comprises an arylamine selected from the group consisting of N,N'-diphenyl-N,N'-bis(alkylphenyl)-1,1-biphenyl-4,4'-diamine, N,N'-diphenyl-N,N'-bis (halophenyl)-1,1'-biphenyl-4,4'-diamine, tritolylamine, N,N'-bis(3,4-dimethylphenyl)-N"-(1-biphenyl) amine, 2-bis((4'-methylphenyl) amino-p-phenyl) 1,1-diphenyl ethylene, and 1-bisphenyl-diphenylamino-1-propene.

4. An imaging member according to claim 1 wherein the hindered phenol comprises octadecyl 3,5-di-tert-butyl-4-hydroxyhydrocinnamate.

5. An imaging member according to claim 1 wherein the hindered phenol is covalently bonded to a polymer selected from the group consisting of polyesters, polyvinyl butyrals, polycarbonates, polystyrene-b-polyvinyl pyridine, poly(vinyl butyral), poly(vinyl carbazole), poly(vinyl chloride), polyacrylates, polymethacrylates, copolymers of vinyl chloride and vinyl acetate, phenoxy resins, polyurethanes, poly (vinyl alcohol), polyacrylonitrile, polysilsesquioxane, and polystyrene.

6. An imaging member according to claim 1 wherein the hindered phenol is covalently bonded to a polystyrene copolymer.

7. An imaging member according to claim 1 wherein said hindered phenol is octadecyl-3,5-di-tert-butyl-4-hydroxyhydrocinnamate and which phenol is covalently bonded to a polystyrene copolymer.

8. An imaging member according to claim 1 further comprising an adhesive layer and an optional overcoat layer.

9. An imaging member according to claim 1 wherein said substrate has a thickness of from about 50 micrometers to about 1,000 micrometers.

10. An imaging member according to claim 1 wherein said substrate has a thickness of from about 80 to about 120 micrometers.

11. An imaging member according to claim 1 wherein said charge blocking layer comprises zinc oxide, titanium oxide, silica, polyvinyl butyral, and phenolic resins.

12. An imaging member according to claim 1 wherein said charge blocking layer has a thickness of from about 2 micrometers to about 4 micrometers.

13. An imaging member according to claim 1 wherein said charge generating layer comprises Type V hydroxygallium phthalocyanine, chlorogallium phthalocyanine, x-polymorph metal-free phthalocyanine, vanadyl phthalocyanine, or trigonal selenium photogenerating pigments dispersed in an arylamine hole transport matrix.

14. An imaging member according to claim 1 wherein said charge generating layer comprises hydroxygallium phthalocyanine.

15. An image-forming device comprising at least a photoreceptor and a charging device which charges the photoreceptor, and wherein the photoreceptor comprises, a substrate, a charge generating layer, and a charge transport layer, wherein the charge transport layer is coated in two passes, the first pass comprising a charge transport component and a polycarbonate polymer binder, and wherein the second pass comprises a coating that includes a charge transport component, a hindered phenol covalently bonded to a polymer, and an additional polymer binder other than the polymer having a hindered phenol covalently bonded thereto.

16. An image-forming device according to claim 15 wherein said charge transport layer comprises binder in an amount of from about 20 to about 80 percent by weight.

17. An image-forming device according to claim 15 wherein said charge transport layer comprises binder in an amount of from about 60 to about 80 percent by weight.

18. An image-forming device according to claim 15 wherein the charge transport layer comprises charge transport component in an amount of from about 20 to about 80 percent by weight.

19. An image-forming device according to claim 15 wherein the charge transport layer comprises charge transport component in an amount of from about 20 to about 40 percent by weight.

20. The image forming device according to claim 15 wherein the photoreceptor is in the form of a belt.

21. The image forming device according to claim 15 wherein the photoreceptor is in the form of a drum.

22. The image forming device according to claim 15 and further comprising a hole blocking layer, an adhesive layer, and an overcoat layer.

* * * * *